US008616375B2

(12) United States Patent
Welch

(10) Patent No.: US 8,616,375 B2
(45) Date of Patent: Dec. 31, 2013

(54) PACKETS FOR TREATING CHEMISTRY

(75) Inventor: Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/349,907

(22) Filed: Jan. 13, 2012

(65) Prior Publication Data

US 2013/0180871 A1 Jul. 18, 2013

(51) Int. Cl.

| | |
|---|---|
| ***B65D 85/84*** | (2006.01) |
| ***B65D 35/08*** | (2006.01) |
| ***B65D 47/10*** | (2006.01) |
| ***A47L 1/08*** | (2006.01) |
| ***C11D 17/04*** | (2006.01) |

(52) U.S. Cl.
USPC ..... 206/524.7; 222/107; 222/541.3; 401/25; 510/439

(58) Field of Classification Search
USPC ..... 206/524.7; 510/296, 297, 439; 222/92, 222/107, 212, 129, 215, 541.3, 541.9; 401/19, 23, 25–27
See application file for complete search history.

(56) References Cited

U.S. PATENT DOCUMENTS

| | | | | |
|---|---|---|---|---|
| 4,356,099 | A * | 10/1982 | Davies et al. | 206/524.7 |
| 4,358,028 | A | 11/1982 | Chiquiar-Arias | |
| 4,606,775 | A * | 8/1986 | Robinson et al. | 510/439 |
| RE33,646 | E | 7/1991 | Klemm et al. | |
| 5,078,301 | A * | 1/1992 | Gladfelter et al. | 222/52 |
| 5,234,615 | A * | 8/1993 | Gladfelter et al. | 510/439 |
| 5,529,224 | A * | 6/1996 | Chan et al. | 222/107 |
| 5,996,845 | A * | 12/1999 | Chan | 222/107 |
| 6,624,130 | B2 * | 9/2003 | Giblin et al. | 510/297 |
| 7,757,893 | B2 * | 7/2010 | Perell | 222/107 |
| 2005/0233925 | A1 | 10/2005 | Foley et al. | |
| 2006/0213801 | A1 * | 9/2006 | Karaoren et al. | 206/524.7 |
| 2008/0011870 | A1 | 1/2008 | Link et al. | |
| 2008/0058239 | A1 * | 3/2008 | Evers et al. | 510/439 |
| 2010/0270330 | A1 | 10/2010 | Caldwell et al. | |
| 2010/0320206 | A1 | 12/2010 | Caldwell et al. | |

FOREIGN PATENT DOCUMENTS

WO 02/08376 A1 1/2002

* cited by examiner

*Primary Examiner* — Bryon Gehman

(57) ABSTRACT

A dishwasher treating packet for use in a dishwasher having a treating chamber comprising a body defining a reservoir, a treating chemistry in the reservoir, and a manual dispenser coupled to the reservoir and selectively operable to dispense at least a portion of the treating chemistry from the reservoir.

16 Claims, 2 Drawing Sheets

PACKETS FOR TREATING CHEMISTRY

BACKGROUND OF THE INVENTION

Contemporary dishwashers have a treating chamber in which utensils are received for treatment using one or more treating liquids to wash off food soil from the surface of the utensils according to a washing cycle. The treating liquid may include at least one of water and treating chemistry. The treating liquid is recirculated throughout the treating chamber to aid in the removal of soils. Most soils are easily removed. However, heavy soils or baked-on soils still present a problem for removal.

BRIEF DESCRIPTION OF THE INVENTION

A dishwasher treating packet having a body defining a reservoir and having at least a portion made from a dissolvable material, a treating chemistry in the reservoir, and a manual dispenser coupled to the reservoir and selectively operable to dispense at least a portion of the treating chemistry from the reservoir.

DESCRIPTION OF EMBODIMENTS OF THE INVENTION

The invention is generally directed toward a dishwasher treating packet having a treating chemistry in the interior of the dishwasher treating packet. The particular approach of the invention is to provide the treating packet having one or more treating chemistries to selectively dispense first treating chemistry to utensils having heavy soils prior to dispensing second treating chemistry during a cycle of operation. For purposes of this description, the term "utensil(s)" is intended to be generic to any item, single or plural, that may be treated in the dishwasher 10, including, without limitation; dishes, plates, pots, bowls, pans, glassware, and silverware.

Figure 1:
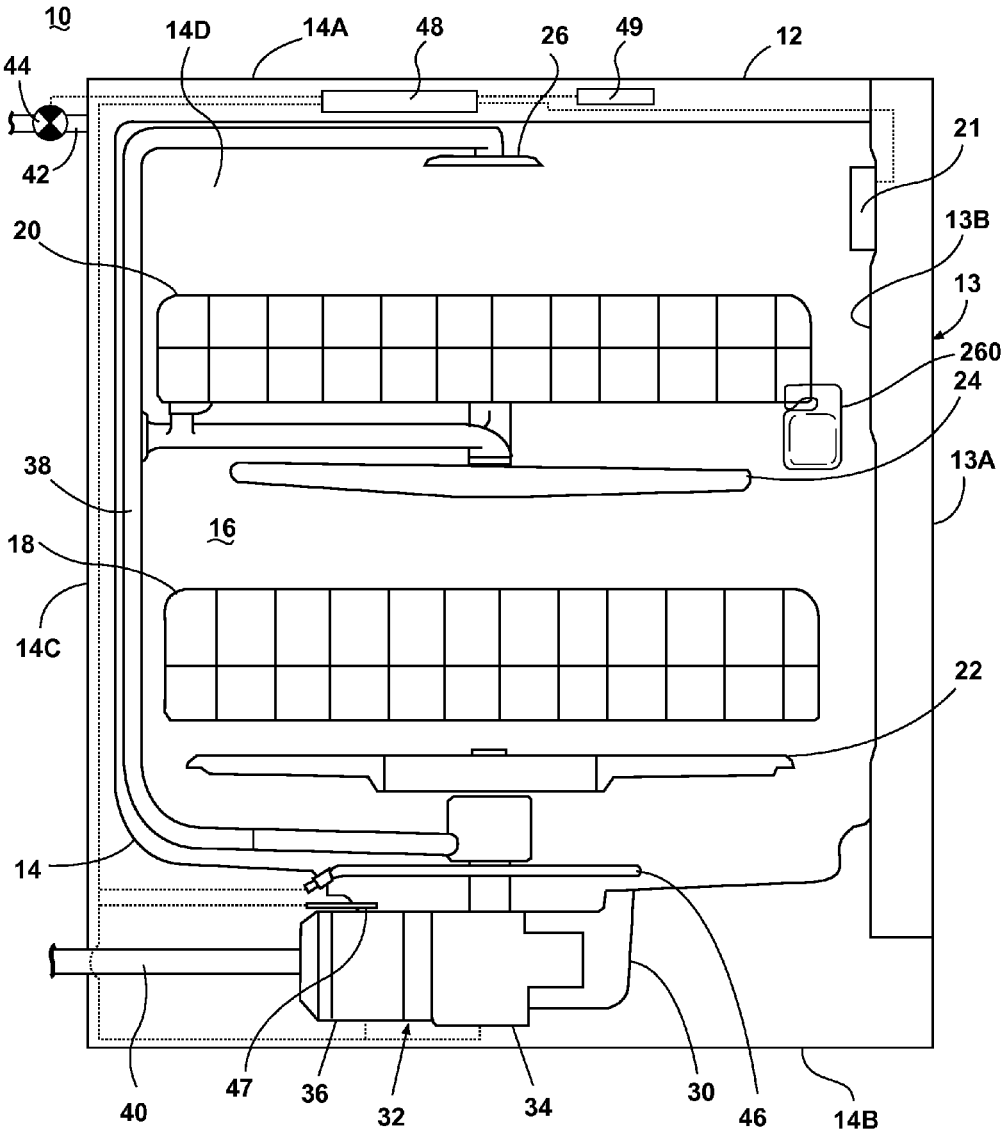
FIG. 1 is a schematic, side view of an automatic dishwasher illustrating a typical environment for the invention.

FIG. 1 is a schematic, side view of a treating appliance, which is illustrated in the context of an automatic dishwasher 10. While the illustrated treating appliance may be a dishwasher 10, other treating appliances are possible, non-limiting examples of which include other types of dishwashing units, such as in-sink dishwashers, multi-tub dishwashers, drawer-type dishwashers. The dishwasher 10, which shares many features of a conventional automatic dishwasher, will not be described in detail herein except as necessary for a complete understanding of the invention.

The dishwasher 10 may have a cabinet 12 defining an interior, which is accessible through a door 13. The cabinet 12 may comprise a chassis or frame to which optional decorative panels may be mounted. For built-in dishwashers, the outer panels are typically not needed. At least one wash tub 14 is provided within the interior of the cabinet 12 and defines a treating chamber 16 to receive and treat utensils according to a cycle of operation. The wash tub 14 has an open face that is closed by the door 13.

The door 13 and wash tub 14 may comprise large planar elements. For example, the door 13 may have a front panel 13A and rear panel 13B, which define a space therebetween. The wash tub 14 may be a stamped metal tub or an injection molded plastic tub, with top wall 14A, bottom wall 14B, rear wall 14C and opposing side walls 14D. The walls all define large planar elements. If there are decorative panels attached to the chassis or frame, they also would form large planar elements.

A treating chemistry dispenser 21 may be located in the door 13. It will be understood that depending on the type of dishwasher and the type of treating chemistry used, the treating chemistry dispenser 21 may be incorporated into one dispensing mechanism. The treating chemistry dispenser 21 may be of a single use dispenser type or a bulk dispenser type. In the case of bulk dispensing, the treating chemistry such as detergent and/or rinse aid can be selectively dispensed into the treating chamber 16 in a regulated quantity and at a predetermined time or multiple times during a cycle of operation. The controlled amount of treating chemistry may be also configured to dispense at a predetermined temperature during a cycle of operation.

One or more utensil racks, such as a lower utensil rack 18 and an upper utensil rack 20 may be provided in the treating chamber 16. The racks 18, 20 may hold utensils (not shown) that may be treated in the treating chamber 16. The racks 18, 20 may be slid in and out of the treating chamber 16 through the opening closed by the door 13. It may be noted that a treating packet 260 with treating chemistry may be coupled to one of the racks 18, 20 in the treating chamber 16.

A spray system may be provided for supplying liquid to the treating chamber 16 as part of a cycle of operation for washing any utensils within the racks 18, 20. The spray system may include one or more liquid sprayers, which are illustrated in the form of spray arm assemblies 22, 24, 26, that are provided within the treating chamber 16 and are oriented relative to the racks 18, 20 such that liquid sprayed from the spray arm assemblies 22, 24, 26 may be directed into one or more of the racks 18, 20.

It should be noted that the stacked arrangement of the utensil racks 18, 20 and the spray arm assemblies 22, 24, 26 is not limiting to the invention. It merely serves to illustrate the invention. For example, the invention may be implemented in a stacked arrangement having a silverware basket, the lower and upper utensil rack, and with upper, middle, and lower level spray arm assemblies having spray heads for the silverware basket alternatively arranged in between the lower and upper utensil rack.

A recirculation system comprises a pump assembly 32 and recirculates sprayed liquid in the treating chamber 16 to the spray system. A sump 30 may be provided to collect, by gravity, the sprayed liquid. The sump 30 may be illustrated as being formed with or affixed to a lower portion of the wash tub 14 to collect liquid that may be supplied into or circulated in the wash tub 14 during, before, or after a cycle of operation. However, the sump 30 may be remote from the wash tub 14 and fluidly coupled by suitable fluid conduits.

The pump assembly 32 may be fluidly coupled to the sump 30, and as illustrated, may include a recirculation pump 34 and a drain pump 36. The recirculation pump 34 fluidly couples the sump 30 to the spray arm assemblies 22, 24, 26 through a spray arm supply conduit 38 to recirculate liquid that collects in the sump 30 to the spray arm assemblies 22, 24, 26 for spraying on the racks 18, 20. The drain pump 36 fluidly couples the sump 30 to a drain conduit 40 for draining liquid collected in the sump 30 to a household drain, such as a sewer line, or the like.

While the pump assembly 32 may include the recirculation pump 34 and the drain pump 36, in an alternative embodiment, the pump assembly 32 may include a single pump, which may be operated to supply liquid to either the drain conduit 40 or the spray arm support conduit 38, such as by rotating in opposite directions or by valves. Each of the recirculation pump 34 and drain pump 36 may be operably coupled to a separate motor (not shown) while one motor may be shared by a single pump assembly 32.

A liquid supply, which is illustrated as a water conduit 42, may be configured to couple to a household water supply line, and a valve 44, such as a solenoid valve, which couples the water conduit to the treating chamber 16. The ON/OFF actuation of the valve controls the supply of water into the treating chamber.

A heating system, which is illustrated as comprising an immersible, resistive heating element 46, is provided for heating liquid in the treating chamber 16. A temperature sensor 47 such as a thermistor may also be positioned in the sump 30 to provide an output signal that is indicative of any liquid temperature or air temperature in the sump 30. Other sensors (not shown) such as a pH sensor or a turbidity sensor may be positioned in the sump 30 to provide an output signal that is indicative of the liquid in the sump 30.

The dishwasher 10 further comprises a controller 48 for implementing one or more cycles of operation. The dishwasher 10 may be preprogrammed with a number of different cleaning cycles from which a user may select one cycle of operation to treat a load of utensils. Examples of cycle of operations include normal, light/china, heavy/pots and pans, and rinse only. The controller 48 may be operably coupled to various components of the dishwasher 10 to implementing a cycle of operation in the treating chamber 16. For example, the controller 48 is operably coupled to the dispenser 21, pumps 34, 36, valve 44, heating element 46, temperature sensor 47 and other sensors to control their operation to implement a cycle of operation. The controller 48 may be a microprocessor controller having one or more cycles of operation stored in memory and selectable by the user via a user interface 49. The cycles of operation may comprise a plurality of instructions that are executable by the microprocessor.

In typical use, treating chemistry is supplied by a user of the dishwasher 10 into the dispenser 21 and the controller 48 effects the dispensing of the treating chemistry from the dispenser 21 at the appropriate time during the cycle of operation. Alternatively, the treating chemistry may be placed directly in the treating chamber 16 by the consumer. In either case, the treating chemistry is generally distributed to the treating chamber 16, where it will be mixed with and diluted by the supplied water to form a treating liquid that is then recirculated onto the utensils. Neither approach provides for the localized application of the treating chemistry within the treating chamber 16.

The invention addresses this shortcoming by providing the treating chemistry in a treating packet that provides for the direct application of at least a portion of the treating chemistry onto one or more of the utensils, such as at the location of heavy or baked-on soil, or locating of the treating chemistry at a predetermined location in the treating chamber, such as where heavy or baked-on soils are expected, for subsequent delivery during the cycle of operation, such as the dissolving of the packet at the desired point in the treating cycle of operation.

Figure 2A:
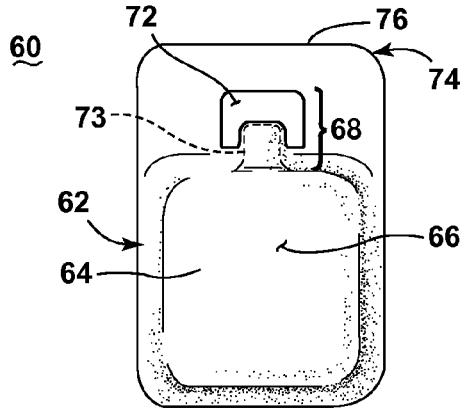
FIG. 2A is a schematic, front view of a dishwasher treating packet for the dishwasher of FIG. 1, according to a first embodiment of the invention.
Figure 2B:
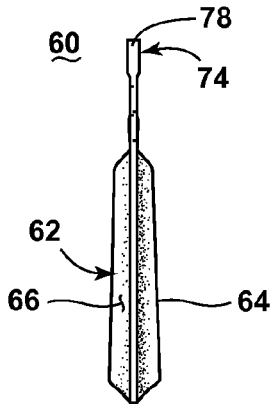
FIG. 2B is a schematic, side view of a dishwasher treating packet for the dishwasher of FIG. 1, according to a first embodiment of the invention.

A first embodiment of such a treating packet 60 is illustrated in FIGS. 2A and 2B, which are front and side schematic views of the dishwasher treating packet, respectively. The dishwasher treating packet 60 may include a body 62 defining a reservoir 64 to hold a treating chemistry 66. The body 62 may have at least a portion which comprises a material that may be dissolved into the treating liquid during the expected environmental conditions of the cycle of operation. For example, the material may be dissolvable above a predetermined temperature and/or by a chemical encountered during the cycle of operation. The body 62 may be also compressible such that the treating chemistry 66 in the reservoir 64 may be aided in dispensing from the interior of the reservoir 64 to the exterior of the reservoir 64. As illustrated, the body 62 may be in the form of a rectangular shaped container while other geometrical shapes are also possible.

It is contemplated that one or more reservoirs 64 may be provided with the body 62. For example, the body 62 may include first and second reservoirs for separately storing the first and second treating chemistries in the first and second reservoirs, respectively, with the first and second reservoirs fluidly separated from each other to prevent from intermixing of the first and second treating chemistries.

A manual dispenser 68 may be formed on the body 62 to fluidly couple to the treating chemistry 66 stored in the reservoir 64. The manual dispenser 68 may selectively operate to dispense at least a portion of the treating chemistry 66 from the interior of the reservoir 64 to the surface of heavy soiled utensils outside the reservoir 64. As illustrated, the manual dispenser 68 may include a cut-out 72, which may be formed in one portion of the packet 60. While a U-shaped cut-out 72 is illustrated as an embodiment, it may be understood that the cut-out may have other geometric shapes. A perforation 73 may be formed in the body 62, next to the U-shaped cut-out 72.

An applicator 74 may be formed in the form of a spreading element in the treating packet 60. For example, one end portion 76 of the treating packet 60 may be used as the spreading element. The spreading element 74 may have a thickened cross-sectional area 78 compared to other portions of the body 62.

When the user tears away or breaks off the perforation 73, an opening may be formed along the perforation 73. Then the treating chemistry 66 in the reservoir 64 may be exposed to the ambient atmosphere. By applying compressive force to the reservoir 64, for example, by squeezing the reservoir 64, the treating chemistry 66 may be dispensed from the interior of the reservoir 64 via the opening to the heavily soiled utensils. In case the high viscosity treating chemistry is applied to the utensils, the user may use the spreading element 74 to further uniformly spread out the treating chemistry 66 dispensed on the utensil surface.

The dishwasher treating packet 60 with a remaining treating chemistry may then be placed within the treating chamber 16 of the dishwasher 10 before the user starts a cycle of operation. For example, the dishwasher treating packet 60 may be tossed over into the treating chamber 16. Alternatively, the treating packet 60 may be placed in the treating chemistry dispenser 21. After that, the door 13 of the dishwasher 10 may be closed to start a washing cycle.

A cycle of operation may be configured to include a pre-treatment step during which the treating chemistry 66 directly applied to the heavily soiled utensil may be provided a predetermined period of time to react with and loosen the heavy soil. The pre-treatment step may be performed in the presence or absence of liquid. The pre-treatment step may be performed at a predetermined temperature range. After the completion of the pre-determined step, a main wash step may begin to treat the soils from the utensils. The main wash step may be performed in the presence of liquid in the treating chamber 16. When the temperature within the treating chamber 16 satisfies a predetermined temperature, a portion of the body 62 of the treating packet 60 may be dissolved into the liquid to form an exit for the treating chemistry 66 in the reservoir 64. For example, the exit may be in the form of a small opening, while most of the body 62 may be configured to dissolve away for a quick chemistry release. When the exit is formed, the treating chemistry in the reservoir 64 may be released through the exit by gravity to the interior of the treating chamber 16 to treat the utensils according to a cycle of operation.

Figure 3A:
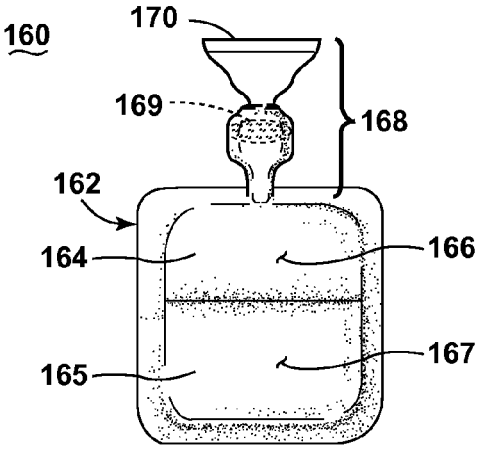
FIG. 3A is a schematic, front view of a dishwasher treating packet for the dishwasher of FIG. 1, according to a second embodiment of the invention.
Figure 3B:
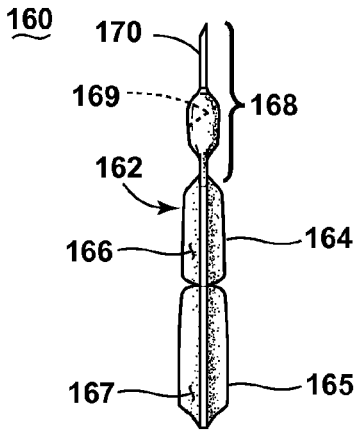
FIG. 3B is a schematic, side view of a dishwasher treating packet for the dishwasher of FIG. 1, according to a second embodiment of the invention.

FIGS. 3A and 3B are front and side schematic views of a dishwasher treating packet 160 for a dishwasher 10 according to a second embodiment of the invention, respectively. Similar to the treating packet described in FIGS. 2A and 2B, the dishwasher treating packet 160 includes a body 162, at least a portion of which may be dissolvable into the treating liquid.

A manual dispenser 168 may be extended from the body 162 and may be fluidly coupled to the reservoir 164 having a treating chemistry 66. The manual dispenser 168 may be either detachably or integrally coupled to the reservoir. As illustrated, the manual dispenser 168 may be in the form of a tube or a pipe having a predetermined opening size. The manual dispenser 168 may also include a spray head 169 in the tube 168, where the spray head 169 and the tube 168 may be fluidly coupled to the treating chemistry 66 in the reservoir 164.

A removable closure element 170 may be coupled to the tube 168. For example, the removable closure element 170 may be in the form of a tear-away portion that may be coupled to the one end of the tube 168. The tear-away portion 170 may be configured to seal the opening of the tube 168 before the tear-away portion is removed. The tear-away portion 170 may be in the form of a tab or a flap with any geometry.

The tear-away portion 170 may be twisted off or torn off to expose the spray head 169 in the tube 168 to the ambient atmosphere. Then, the body 162 may be squeezed to transfer a portion of the treating chemistry 66 in the reservoir 164 via the opening of tube 168 to the exterior of the dishwasher treating packet 160. The amount of the treating chemistry 66 dispensed may be dependent upon at least one of the squeezing pressure, squeezing time, configuration of spray head, and the opening diameter of the tube 168. Medium or low viscosity treating chemistry may be dispensed (or sprayed) through the spray head 169 in the tube 168 to the heavily soiled utensil while the treating chemistry having high viscosity may be also dispensed through the tube 168.

The first embodiment discloses a single reservoir. In some applications, it may be desirable to use multiple reservoirs. For example, it may be desirous to dispense multiple treating chemistries or the same treating chemistry at different times. For example, two different treating chemistries such as detergent and rinse aid may be provided to complete a cycle of operation. In another example, two treating chemistries having different concentrations may be configured to sequentially provide to the utensils. That is, highly concentrated treating chemistry may be provided first to remove heavy soils, followed by low concentration treating chemistry for treating non-heavy soils.

As illustrated, for selectively supplying a plurality of treating chemistries according to a cycle of operation, the treating packet 160 with multiple reservoirs may be provided. For example, the treating packet 160 may be provided with a first reservoir 164 for storing a first treating chemistry 166 and a second reservoir 165 for storing a second treating chemistry 167. It may be understood that the first treating chemistry 166 and the second treating chemistry 167 may differ by at least one of chemical composition or concentration.

In one embodiment, the treating packet 160 may be configured to have only a first reservoir 164 fluidly coupled to the manual dispenser 168. Further, a portion of the second reservoir 165 only may be configured to dissolve into the liquid above a predetermined temperature while the first reservoir 164 is not physically or chemically affected by the temperature to form an exit.

Prior to a cycle of operation, the first treating chemistry 166 in the first reservoir 164 may be manually dispensed by the user to the utensil while the second treating chemistry 167 in the second reservoir 165 is fluidly separated from the first reservoir 164. After dispensing the first treating chemistry 166 to the utensil, the entire treating packet 160 may be placed in the treating chamber 16 to start a cycle of operation. When the cycle of operation begins, only the first treating chemistry 166 may react with the soil on the utensils during a pre-treatment step for a predetermined time period. When the pre-treatment step is done, a main wash step may follow with the supply of liquid into the treating chamber 16, during which only the second treating chemistry 167 may be selectively supplied to the utensils to treat the utensils when a portion of the second reservoir 165 dissolves into the liquid at a predetermined temperature.

Figure 4A:
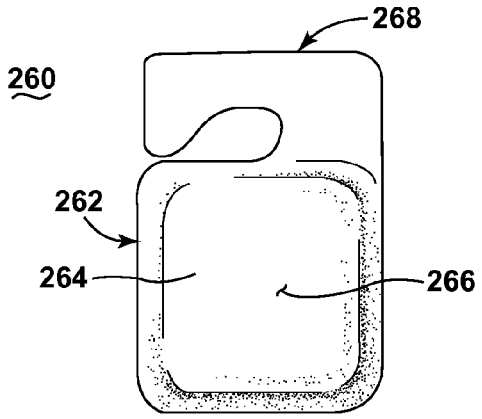
FIG. 4A is a schematic, front view of a dishwasher treating packet for the dishwasher of FIG. 1, according to a third embodiment of the invention.
Figure 4B:
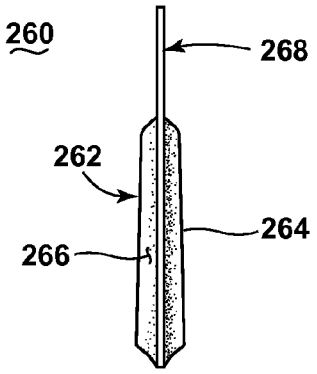
FIG. 4B is a schematic, side view of a dishwasher treating packet for the dishwasher of FIG. 1, according to a third embodiment of the invention.

FIGS. 4A and 4B are front and side schematic view of a dishwasher treating packet 260 for a dishwasher according to a third embodiment of invention, respectively. Similar to the first and second embodiments, the dishwasher treating packet 260 may include a body 262 defining a reservoir 264, a portion of which may be dissolvable into the liquid above a predetermined temperature.

A hook 268 may be operably coupled to a portion of the body 262 to hang the body 262 from a structure within the treating chamber 16. For example, as illustrated in FIG. 1, the dishwasher treating packet 260 may be hanging from the upper utensil rack 20 or any other stationary structure such as the spray arm supply conduit 38. The dishwasher treating packet 260 may be also hanging from any movable structure, such as the spray arm assemblies 22, 24, 26 within the treating chamber 16.

When the dishwasher treating packet 260 is exposed to a predetermined temperature during a washing phase, a portion of the reservoir 264 may be dissolved into the liquid to dispense the treating chemistry 66 in the treating chamber. It is noted the hook 268 may be used in conjunction with the manual dispenser 68, 168 and/or multiple reservoirs 164, 165 to selectively supply one or more treating chemistries in the treating chamber 16.

The hook 268 of the third embodiment may be incorporated into either of the other two embodiments. Similarly, the manual dispensers 68, 168 of the first two embodiments may be incorporated with the third embodiment. In this sense, any features of any embodiment may be incorporated with any of the other embodiments.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A dishwasher treating packet for use in a dishwasher having a treating chamber for receiving utensils for treatment and configured to automatically execute a cleaning cycle of operation to treat the utensils within the treating chamber, the dishwasher treating packet comprising:

a body defining a reservoir and having at least a portion made from a dissolvable material, wherein the body includes a peripheral edge;

a treating chemistry in the reservoir;

a manual dispenser in fluid communication with the reservoir and disposed within a cutout and selectively operable to dispense at least a portion of the treating chemistry from the reservoir; and an applicator spaced from the manual dispenser by the cutout and extending from the body, wherein the applicator is in the form of a spreading element, and the spreading element has a thickened cross-sectional area compared to the peripheral edge of the body;

wherein a user may use the dispensed treating chemistry to spot treat a utensil to be treated in the dishwasher and then place the body within the treating chamber where it will dissolve during the cleaning cycle of operation to dispense any treating chemistry remaining in the reservoir.

2. The dishwasher treating packet of claim 1 wherein the manual dispenser is integrally formed with the body.

3. The dishwasher treating packet of claim 1 wherein the manual dispenser comprises a tube extending from the body and fluidly coupled to the reservoir.

4. The dishwasher treating packet of claim 3 wherein the tube comprises a removable closure element, which may be removed prior to dispensing from the tube.

5. The dishwasher treating packet of claim 4 wherein the removable closure element comprises a tear-away portion of the tube.

6. The dishwasher treating packet of claim 5 wherein the tube is integrally formed with the body.

7. The dishwasher treating packet of claim 6 further comprising a hook for hanging the body from a structure within the treating chamber.

8. The dishwasher treating packet of claim 3 wherein the manual dispenser further comprises a spray head located within the tube.

9. The dishwasher treating packet of claim 1 wherein the body is compressible to aid in the dispensing of the treating chemistry from the reservoir via the manual dispenser.

10. The dishwasher treating packet of claim 1 wherein the reservoir comprises first and second reservoirs, with at least the first reservoir being fluidly coupled to the manual dispenser.

11. The dishwasher treating packet of claim 10 wherein the first and second reservoirs are fluidly separated when the body is not dissolved.

12. The dishwasher treating packet of claim 10 wherein the treating chemistry comprises a first treating chemistry in the first reservoir and a second treating chemistry in the second reservoir, and the first and second treating chemistries differ in at least one of concentration and chemical component.

13. The dishwasher treating packet of claim 1 wherein the body dissolves in liquid above a predetermined temperature.

14. The dishwasher treating packet of claim 13 wherein the predetermined temperature is greater than a temperature reached during the cycle of operation.

15. The dishwasher treating packet of claim 1 further comprising a hook for hanging the body from a structure within the treating chamber.

16. The dishwasher treating packet of claim 1 wherein the manual dispenser further comprises a spray head.

* * * * *